United States Patent [19]

Malito et al.

[11] Patent Number: 4,767,554

[45] **Date of Patent: * Aug. 30, 1988**

[54] POLYCARBOXYLIC ACID ESTER DRAWING AND IRONING LUBRICANT EMULSIONS AND CONCENTRATES

[75] Inventors: John T. Malito, Oswego; Richard D. Wintermute, Glen Ellyn; Scott F. Ross, Chicago; John M. Ferrara, Palos Heights, all of Ill.

[73] Assignee: Nalco Chemical Company, Naperville, Ill.

[ * ] Notice: The portion of the term of this patent subsequent to Dec. 30, 2003 has been disclaimed.

[21] Appl. No.: 98,438

[22] Filed: Sep. 18, 1987

[51] Int. Cl.[4] ..... C10M 173/00

[52] U.S. Cl. ..... 252/49.5; 252/565

[58] Field of Search ..... 252/495

[56] References Cited

U.S. PATENT DOCUMENTS

| | | | |
|---|---|---|---|
| 3,364,143 | 1/1968 | Johnson | 252/49.5 |
| 3,507,792 | 4/1970 | Zuraw | 252/49.5 |
| 3,634,245 | 1/1972 | Meisters | 252/49.5 |
| 3,893,931 | 7/1975 | Sturwold et al. | 252/49.5 |
| 4,151,099 | 4/1979 | Nassry et al. | 252/49.5 |
| 4,178,260 | 12/1979 | Cook et al. | 252/49.5 |
| 4,292,187 | 9/1981 | Hentschel et al. | 252/49.5 |
| 4,518,512 | 5/1985 | Kanamori | 252/49.5 |
| 4,632,770 | 12/1986 | Slanker | 252/49.5 |

OTHER PUBLICATIONS

The HLB System, Copyright 1976, ICI Americas, Revised Mar. 1980.

*Primary Examiner*—William R. Dixon, Jr.
*Assistant Examiner*—E. McAvoy
*Attorney, Agent, or Firm*—John G. Premo; Anthony L. Cupoli; Donald G. Epple

[57] ABSTRACT

A concentrate of the type useful for preparing an oil-in-water emulsion lubricant used in the drawing and ironing of ferrous and non-ferrous metals comprising:

| Ingredient | % by Weight |
|---|---|
| A carboxylic acid ester from the group consisting of: | 60–90 |
| (a) Dibasic acid having at least 70% by weight of its carboxylic acid groups esterified with a $C_4$–$C_{30}$ mohydric alcohol | |
| (b) A $C_8$–$C_{22}$ mono carboxylic acid ester of a polyhydric alcohol. | |
| Water-in-oil emulsifying agent, | .5–30 |
| Polyglycol co-emulsifier | 2–4 |
| Phosphate corrosion inhibitor | 0.5–2 |
| Copper corrosion inhibitor | 0.2–1 |
| Thickener | 0–10 |

the improvement which comprises said composition having an Iodine number not greater than 5.

7 Claims, No Drawings

POLYCARBOXYLIC ACID ESTER DRAWING AND IRONING LUBRICANT EMULSIONS AND CONCENTRATES

U.S. Pat. No. 4,632,770, which is incorporated herein by reference, describes and claims drawing and ironing lubricant emulsions and concentrates which have a number of advantages. The teachings of this patent are reproduced in part below:

INTRODUCTION

In the fabricating of metal into complex shapes such as the drawing and ironing steps used in producing a can from a sheet of aluminum or steel, a number of different lubricants are involved. Residual oils are present on most sheet surfaces from prior rolling and fabricating operations. An additional process lubricant is used for the drawing operation. A third process lubricant is used for the ironing operation. Finally, a mechanical or hydraulic lubricant associated with the press equipment may become inadvertently mixed with the process lubricants. Normally these lubricants have different compositions although it is known to use the same lubricant in both drawing and ironing operations although at different concentrations.

The ideal drawing and ironing lubricant would have the following properties and characteristics:

A. Improved lubrication, lower use concentration.

B. Cleans easier. It washes off the cans using less washer chemicals.

C. Improved housekeeping. The equipment and floor areas are significantly cleaner.

D. Improved effluent treatment. Less chemicals and equipment are required to treat the effluent.

E. Reclaimability. Can reclaim material easily using conventional equipment.

F. Reoil lubricant. Can also be employed as a reoiling lubricant for coil stock before the drawing and ironing process.

G. Synthetic machine/hydraulic lubricant. With modifications, can also be employed as the machine/hydraulic lubricant for the equipment in the drawing and ironing process.

THE INVENTION

In its broadest aspect, the invention comprises a concentrate useful for preparing an oil-in-water emulsion lubricant used in the drawing and ironing of ferrous and non-ferrous metals comprising:

| Ingredient | % by Weight |
|---|---|
| $C_2$–$C_{10}$ polycarboxylic acid having at least 70% by weight of its carboxylic acid groups esterified with a $C_4$–$C_{30}$ monohydric alcohol | 50–90 |
| Water-in-oil emulsifying agent having a HLB number of at least 8 | .5–30 |
| Polyglycol co-emulsifier | 0–8 |
| Phosphate corrosion inhibitor | 0–3 |
| Copper corrosion inhibitor | 0–2 |

The concentrates of the above type are formed into oil-in-water emulsions by adding them to water. The amount of concentrate in the water may vary between as little as 0.5% up to about 50% by weight. In a preferred embodiment, the amount of concentrate of the finished emulsion ranges between 1–30% by weight.

The lubricants of the invention, while being capable of use in the drawing and ironing of both ferrous and non-ferrous stock, are particularly useful in the ironing and drawing operations performed on aluminum. The amount used is that amount which will provide adequate lubricity, cooling, and the like, for the particular metal working operation in which the lubricant is used.

THE POLYCARBOXYLIC ACID MONOHYDRIC ALCOHOL ESTERS

As indicated, the polycarboxylic acids have at least 70% of their carboxylic acid groups esterified with the monohydric alcohol. Preferably, these acids have 90% up to almost complete esterification of the carboxylic acid groups. In certain instances, minor amounts of unesterified acid groups improve the emulsifiability of the concentrates.

The Carboxylic Acids

While polycarboxylic acids containing between $C_2$–$C_{10}$ or greater atoms may be used, it is preferred to use those containing between $C_4$–$C_{10}$. Two preferred acids are adipic and citric. Illustrative of other such acids are the following:

Oxalic
Malonic
Succinic
Glutaric
Adipic
Pimelic
Suberic
Azelaic
Sebacic
Undecanedioic.

It is evident from the above that the acids are aliphatic. They may contain elements other than hydrogen and carbon such as OH, Cl, S and the like.

THE MONOHYDRIC ALCOHOLS

The monohydric alcohols contain between $C_4$–$C_{30}$ carbon atoms. Preferably they contain $C_4$–$C_{18}$, with a most preferred being oxo alcohols containing mixtures of $C_6$–$C_{10}$ alcohols. Illustrative of alcohols that may be used are the following:

n-Butyl alcohol
Isobutyl alcohol
sec-Butyl alcohol
tert-Butyl alcohol
n-Amyl alcohol
Isoamyl alcohol
tert-Amyl alcohol
sec-Amyl alcohol
Diethylcarbinol
Active amyl alcohol (d-amyl alcohol)
n-Hexyl alcohol
n-Heptyl alcohol
n-Octyl alcohol
sec-n-Octyl alcohol
n-Nonyl alcohol
n-Decyl alcohol
n-Undecyl alcohol
Lauryl alcohol
Myristyl alcohol
Cetyl alcohol
Stearyl alcohol
Crotyl alcohol Oleyl alcohol
Citronellol
Geraniol.

The esters are prepared using conventional esterification procedures which are well-known and need not be described.

Two preferred esters of the $C_6$–$C_{10}$ are oxo alcohol and ester of adipic and citric acid.

THE OIL-IN WATER EMULSIFYING AGENTS

As indicated, these materials are used in the concentrate in amounts between 0.5–30% and preferably 8–20% by weight of the concentrate. While any oil-in-water emulsifying agents may be used, it is desirable that they have an HLB number of at least 8. The HLB system for classifying emulsifying agents is described in detail in the publication "The HLB System", Copyright 1976, ICI Americas, Revised, March, 1980. This publication describes a host of emulsifying agents and mixtures thereof which are capable of providing oil-in-water emulsions. The disclosure of this publication is incorporated herein by reference.

A preferable class of emulsifying agents are the unsaturated higher fatty acids, specifically oleic acid in the form of its water-soluble salt and most preferably in the form of an amine salt, particularly its isopropanol amine salt.

THE CO-EMULSIFIER

While the high HLB emulsifier described above may be used alone, improved results are afforded by using a water-soluble low molecular weight polyoxyalkylene glycol having a molecular weight below 400. A preferred glycol is diethylene glycol. When used, the polyglycol is used in amounts ranging from 0–8% by weight and preferably 3–6% by weight.

THE FERROUS METAL CORROSION INHIBITOR

To minimize corrosive attack to ferrous metals in contact with the concentrate and the emulsions prepared therefrom, it is desirable that a corrosion inhibitor such as a water-soluble polyphosphate, e.g. hexametaphosphate, or an organic phosphate such as amyl acid phosphate be used. When used, the amounts vary between 0–3%. Preferably, the dosage is 1.5–2% by weight of the concentrate.

THE COPPER CORROSION INHIBITOR

It is also beneficial, but not necessary, to include in the concentrates a corrosion inhibitor for copper and copper alloys. This may be selected from a wide variety of copper inhibitors such as the mercaptobenzotriazole. Tolytriazole represents a preferred copper inhibitor.

When used, the amounts range between 0–2% and preferably 0.5–1.5%.

While drawing and ironing lubricants of the type described in U.S. Pat. No. 4,632,770 have proven satisfactory, they have presented certain drawbacks that render their use not entirely satisfactory. One of the major problems associated with lubricants described in U.S. Pat. No. 4,632,770 resides in their tendency to form sludge in the tooling and can making machinery which contacts these lubricants, particularly at higher values of pH. These sludges are believed to result primarily from the formation of insoluble aluminum and hard-water soaps of the unsaturated fatty acids which comprise the preferred water-in-oil emulsifying agents described in this patent. These sludges degrade lubrication, and can be transferred to the can so as to interfere with subsequent can washing stage or in the extreme, rejection of the can due to "black spots". At lower pH values, where formation of soaps is minimized, these lubricants exhibit reduced wetting on the non-ferrous metals being worked. Also, they tend to be subject to bacterial infestation leading to degradation of the oil-in-water emulsion.

The present invention represents an improvement in the lubricants described in U.S. Pat. No. 4,632,770. The improvement afforded by the present invention imparts to the composition of U.S. Pat. No. 4,632,770 the following advantages:

1. Better lubrication (higher load bearing capability and less scarring, as indicated by the Alpha Ring and Block Lubrication Test).
2. Greater wetting of aluminum can stock due to excellent penetration of emulsion lubricant through organic coatings present on the metal surface.
3. Greatly reduced tendency to form aluminum soaps (residue or sludge) which adversely effect lubrication and can quality.
4. Better detergency to keep tooling and can making equipment cleaner.
5. No formation of insoluble hard water soaps or inverts.
6. Extreme ease with which the emulsion is washed from the can, resulting in low washer chemical costs.
7. Ease of de-emulsification upon acidification allows better waste treatment and disposal.
8. Increased rejection of machine oil which leaks out of the can making equipment into the lubrication emulsion.
9. Low iodine value, indicating a low potential for formation of compound which impart obnoxious flavor to the can content (beer).
10. Greater resistance to microbial infection to minimize biocide consumption.

In addition to using the polycarboxylic acid esters of $C_4$–$C_{10}$ monohydric alcohols, it is also possible to use the fatty acid esters of polyhydric alcohols. The fatty acids contain from $C_8$–$C_{22}$ carbon atoms. Such acids are illustrated by the well-known acids which are derived from animal fats and vegetable oils. Specifically, illustrative of such acids are the following: caproic, caprylic, capric, lauric, myristic, palmitic, stearic, palmitoleic, oleic, erucic, and linoleic.

Polyhydric alcohols may be selected from any number of well-known alcohols illustrated by the following: ethylene glycol, diethylene glycol, triethylene glycol, hexylene glycol, mono-, di- and tri-pentaerythritols.

The improvement resides in the fact that the lubricants of this invention are formulated with selective exclusion of fatty acids and the proper choice of emulsifier systems so as to provide finished products which have the desirable properties listed above. Also, the finished products should have an iodine number not greater than 5, if these products are to be used for production of aluminum cans for packaging beer. The formulae should be free of soap-forming functional groups, particularly carboxylic acid group. Thus, in place of the carboxylic acid soaps which represent the preferred water-in-oil emulsifying agents of U.S. Pat. No. 4,632,770, it is preferred to use water-in-oil emulsifying agents which are free of carboxylic acid groups and ethylenic or acetylenic unsaturation. Thus, unsaturated fatty acids are not present in the finished formulations of this invention.

In lieu of the unsaturated fatty acid emulsifiers specified in U.S. Pat. No. 4,632,770, it is preferred to use the following general class of emulsifiers:

1. Non-ionic, which employ neutral molecules such as amides and alkoxylated derivatives of alcohols, alkylphenols, and fatty acids such as the following:

amides of fatty acids $$R—C(O)NR_1R_2$$

where R and at least one of $R_1$ and $R_2$ is an alkyl group such as:

n-butyl
isobutyl
sec-butyl
tert-buty
n-amyl
isoamyl
sec-amyl
tert-amyl
n-hexyl
n-heptyl
n-octyl
sec-n-octyl
2-ethyl-n-hexyl
n-nonyl
n-decyl
n-undecyl
lauryl
myristyl
palmityl
cetyl
stearyl
oleyl
behenyl ethoxylated or propoxylated alcohols, alkylphenols and fatty acids, represented by:

$$R(OCH_2CH_{2-n}(CH_3)_n)_mOH$$

$$RC_6H_4(OCH_2CH_{2-n}(CH_3)_n)_mOH$$

$$RC(O)(OCH_2CH_{2-n}(CH_3)_n)_mOH$$

where n=o (ethoxylated) or n=1 (propoxylated) R is an alkyl group represented by the preceding list.

2. Anionic, such as amine and alkanolamine salts of alkyl and aryl sulfonic acids and alkyl phosphoric acids such as the following:

amine and ethoxylated or propoxylated amine salts of fatty acids, alkyl and aryl sulfonic acids.

amines $NR_1R_2R_3$ where at least one R is an alkyl group from preceding list.

alkoxylated amines $$RN(OCH_2CH_{2-n}(CH_3)_n)_mOH\text{-}(OCH_2CH_{2-n}(CH_3)_n)_p$$

where R is an alkyl group from preceding list
n=0 (ethoxylated or n−1 (propoxylated)
m=1–9
p=1–9 or $$R_1R_2N(OCH_2CH_{2-n}(CH_3)_n)_mOH$$

where $R_1$,$R_2$ are alkyl groups (same or different) from preceding list.
n=0 (ethoxylated) or n=1 (propoxylated)
m=1–9 alkyl sulfonic, aryl sulfonic and alkyl phosphonic acids $$RSO_3H,\ RC_6H_4SO_3H$$

and $$(R_1O)(R_2O)P(O)OH$$

where R,$R_1$ and $R_2$ are alkyl group from preceding list. $R_1$ may be different from $R_2$. One of $R_1$ or $R_2$ may be H.

3. Cationic, such as amines and alkoxylated amines. (See amines and alkoxylated amines listed in No. 2.)

The improved products of this invention optionally contain as additional ingredients a thickener which may be a hydrogenated polyisobutylene or polymer esters such as alkyl methacrylate copolymers.

When such thickeners are used, they are employed within the range of 0–10% by weight.

Based on the above, preferred compositions are set forth below:

| Ingredient | % by Weight |
|---|---|
| A carboxylic acid ester from the group consisting of: | 60–90 |
| (a) Dibasic acid having at least 70% by weight of its carboxylic acid groups esterified with a $C_4$–$C_{30}$ monohydric alcohol | |
| (b) A $C_8$–$C_{22}$ mono carboxylic acid ester of a polyhydric alcohol. | |
| Water-in-oil emulsifying agent, as illustrated above | .5–30 |
| Polyglycol co-emulsifier | 2–4 |
| Phosphate corrosion inhibitor | 0.5–2 |
| Copper corrosion inhibitor | 0.2–1 |
| Thickener | 0–10 |

These compositions have an iodine number less than 5. It is preferred they be free of unsaturation and soap-forming radicals such as carboxylic acid groups.

When the products of this invention are converted into oil-in-water emulsions, it is preferred that such emulsions be maintained within the pH range of 6.5–8.0.

EVALUATION OF THE INVENTION

Listed below is a prior art Composition A and compositions of the invention, Compositions B-I.

COMPOSITION A

| Ingredients | % by Weight |
|---|---|
| $C_2$–$C_{10}$ polycarboxylic acid having at least 70% by weight of its carboxylic acid groups esterified with a $C_4$–$C_{30}$ monohydric alcohol | 50–90 |
| Water-in-oil emulsifying agent, having a HLB number of at least 8 | .5–30 |
| Polyglycol co-emulsifier | 0–8 |
| Phosphate corrosion inhibitor | .0–3 |
| Copper corrosion inhibitor | 0–2 |

COMPOSITION B

| Ingredients | % by Weight |
|---|---|
| di and tri-pentaerythritol esters of $C_8$ acid | 53.4 |
| di-isodecyladipate | 35.6 |
| dodecylbenzene sulfonic acid | 2.3 |
| 5 moles ethoxylated tetra-propylene amine | 5.3 |
| tridecyl acid phosphate | 1.0 |
| hexylene glycol | 2.0 |
| tolyltriazole | 0.4 |

COMPOSITION C

| Ingredients | % by Weight |
|---|---|
| $C_6$–$C_{14}$ alcohol diester of adipic acid | 88.3 |
| dodecylbenzene sulfonic acid | 2.3 |
| 5 moles ethoxylated tetra-propylene amine | 6.0 |
| tridecyl acid phosphate | 1.0 |
| hexylene glycol | 2.0 |
| tolyltriazole | 0.4 |

COMPOSITION D

| Ingredients | % by Weight |
|---|---|
| $C_6$–$C_{14}$ alcohol diester of adipic acid | 88.6 |
| 8 moles ethoxylated stearic acid | 4.0 |
| diethanolamide of oleic acid | 4.0 |
| tridecyl acid phosphate | 1.0 |
| hexylene glycol | 2.0 |
| tolyltriazole | 0.4 |

COMPOSITION E

| Ingredients | % by Weight |
|---|---|
| $C_6$–$C_{14}$ alcohol diester of adipic acid | 86.6 |
| 5 moles ethoxylated tetra-propylene amine | 4.0 |
| 7.5 moles ethoxylated tetra-propylene amine | 4.0 |
| 8 moles ethoxylated stearic acid | 0.5 |
| tridecyl acid phosphate | 1.0 |
| hexylene glycol | 3.5 |
| tolyltriazole | 0.4 |

COMPOSITION F

| Ingredients | % by Weight |
|---|---|
| $C_6$–$C_{14}$ alcohol diester | 86.3 |

-continued

| Ingredients | % by Weight |
|---|---|
| of adipic acid | |
| dodecyl benzene sulfonic acid | 2.3 |
| 5 moles ethoxylated tetra-propylene amine | 7.0 |
| tridecyl acid phosphate | 1.0 |
| isostearic acid | 1.0 |
| hexylene glycol | 2.0 |
| tolyltriazole | 0.4 |

COMPOSITION G

| Ingredients | % by Weight |
|---|---|
| $C_6$–$C_{14}$ alcohol diester of adipic acid | 85.6 |
| 5 moles ethoxylated tetra-propylene amine | 4.0 |
| 7.5 moles ethoxylated tetra-propylene amine | 4.0 |
| 8 moles ethoxylated stearic acid | 0.5 |
| tridecyl acid phosphate | 1.0 |
| hexylene glycol | 3.5 |
| tolyltriazole | 0.4 |
| isostearic acid | 1.0 |

COMPOSITION H

| Ingredients | % by Weight |
|---|---|
| $C_6$–$C_{14}$ alcohol diester of adipic acid | 79.1 |
| An alkyl methacrylate copolymer | 7.0 |
| 5 moles ethoxylated tetra-propylene amine | 4.0 |
| 7.5 moles ethoxylated tetra-propylene amine | 4.0 |
| tridecyl acid phosphate | 1.0 |
| hexylene glycol | 3.5 |
| isostearic acid | 1.0 |
| tolyltriazole | 0.4 |

COMPOSITION I

| Ingredients | % by Weight |
|---|---|
| $C_6$–$C_{14}$ alcohol diester of adipic acid | 82.1 |
| alkyl methacrylate copolymers | 4.0 |
| 5 moles ethoxylated tetra-propylene amine | 4.0 |
| 7.5 moles ethoxylated tetra-propylene amine | 4.0 |
| tridecyl acid phosphate | 1.0 |
| hexylene glycol | 3.5 |
| isostearic acid | 1.0 |
| tolyltriazole | 0.4 |

The above compositions were tested in standard drawing and lubricating tests. The results are set forth below in the Table.

TABLE I

| | | Compositions[1] | | | | | | | | |
|---|---|---|---|---|---|---|---|---|---|---|
| | | A | B | C | D | E | F | G | H | I |
| Acid Break % oil (5% max) | | 3.5 | 5 | 4.5 | 3 | 4 | 4.5 | 4 | 4 | 4 |
| Lubrication | lbs. | | | | | | | | | |
| under various | 36 | — | — | 0.10/2 | — | 0.07/2 | 0.03/2 | 0.11/3 | 0.10/2 | — |
| loads (lbs.) | 54 | 0.17/2 | 0.10/2 | 0.10/3 | 0.12/2 | 0.12/3 | 0.15/3 | 0.09/3 | 0.07/3 | 0.09/2 |
| COF/SCAR[2] | 72 | 0.17/3 | 0.06/3 | 0.10/3 | 0.10/3 | 0.13/3 | 0.10/3 | 0.09/3 | 0.10/3 | 0.08/3 |

TABLE I-continued

| | | Compositions[1] | | | | | | | | |
|---|---|---|---|---|---|---|---|---|---|---|
| | | A | B | C | D | E | F | G | H | I |
| | 105 | 0.10/5 | 0.08/3 | 0.11/3 | 0.09/3 | 0.11/3 | 0.10/3 | 0.11/5 | 0.10/3 | 0.10/3 |
| | 141 | — | 0.10/3 | 0.07/5 | 0.09/5 | 0.10/5 | 0.06/3 | — | 0.06/3 | 0.10/5 |
| | 177 | — | 0.09/3 | — | — | — | 0.07/3 | — | 0.07/5 | — |
| Wettability % coverage | | 50 | 100 | 100 | 40 | 50 | 95 | 95 | 90 | 90 |
| Iodine number | | 11.9 | 1 | 3.3 | 5.5 | 3.3 | 3.8 | 3.1 | 7.9 | — |
| Tramp oil rejection (5% max) | | 0.5 | 4.5 | 2.5 | 1.7 | 2.5 | 4.4 | 3.5 | 3.0 | 3.0 |

[1]composition A from U.S. Pat. No. 4,632,770; Compositions B-I, this patent
[2]COF = coefficient of friction; scar rating, 1 = low wear, 5 = high wear

We claim:

1. A concentrate of the type useful for preparing an oil-in-water emulsion lubricant used in the drawing and ironing of ferrous and non-ferrous metals comprising:

| Ingredient | % by Weight |
|---|---|
| A carboxylic acid ester from the group consisting of: | 60–90 |
| (a) Dibasic acid having at least 70% by weight of its carboxylic acid groups esterified with a $C_4$–$C_{30}$ monohydric alcohol | |
| (b) A $C_8$–$C_{22}$ mono carboxylic acid ester of a polyhydric alcohol. | |
| Water-in-oil emulsifying agent, which is free of unsaturated and soap-forming groups | .5–30 |
| Polyglycol co-emulsifier | 2–4 |
| Phosphate corrosion inhibitor | 0.5–2 |
| Copper corrosion inhibitor | 0.2–1 |
| Thickener | 0–10 |

the improvement which comprises said composition having an Iodine number not greater than 5.

2. The concentrate of claim 1 where the Iodine numer is less than 0.5.

3. The concentrate of claim 1 where the water-in-oil emulsifying agent is from the group consisting of anionic, non-ionic and cationic water-in-oil emulsifying agents.

4. The concentrate of claim 3 where the water-in-oil emulsifying agent is a non-ionic emulsifying agent.

5. The concentrate of claim 4 where the non-ionic water-in-oil emulsifying agent is from the group consisting of amides and alkoxylated derivatives of alcohols, alkylphenols and fatty acids.

6. The concentrate of claim 3 where the water-in-oil emulsifying agent is an anionic emulsifying agent from the group consisting of amines and alkanolamine salts of alkyl and aryl sulfonic and phosphoric acids.

7. The concentrate of claim 3 where the cationic water-in-oil emulsifying agent is from the group consisting of amines and alkoxylated amines.

* * * * *